US006259797B1

(12) United States Patent
Hu

(10) Patent No.: US 6,259,797 B1
(45) Date of Patent: Jul. 10, 2001

(54) METAL BASE DESIGN FOR A SPEAKER

(75) Inventor: Sin-Kai Hu, Taipei (TW)

(73) Assignee: Alertek Corporation, Taipei (TW)

( * ) Notice: Subject to any disclaimer, the term of this patent is extended or adjusted under 35 U.S.C. 154(b) by 0 days.

(21) Appl. No.: 09/322,056

(22) Filed: May 27, 1999

(51) Int. Cl.[7] ..... H04R 25/00

(52) U.S. Cl. ..... 381/396; 340/384.73; 340/388.1; 340/391.1; 340/398.1; 340/384.7; 381/398; 381/412; 381/419; 181/1.53; 181/179

(58) Field of Search ..... 381/87, 162, 386, 381/393, 394, 395, 396, 412, 419, 420, 332, 336, 160, 337, 339, 341, 398; 340/388, 391, 405, 482, 531, 547, 572.8, 693.12, 693.9, 384.4, 384.7, 384.73, 388.1, 391.1, 398.1; 181/156, 199, 144, 145, 148, 150, 179

(56) References Cited

U.S. PATENT DOCUMENTS 3,240,882 * 3/1966 Eichler .
5,537,480 * 7/1996 Boothroyd .
5,878,150 * 3/1999 Okazaki .
6,047,077 * 4/2000 Larsen .
6,072,887 * 6/2000 Wei .

* cited by examiner

*Primary Examiner*—Curtis Kuntz
*Assistant Examiner*—Dionne N. Harvey
(74) *Attorney, Agent, or Firm*—Jiawei Huang; J.C. Patents

(57) ABSTRACT

A metal base assembly for speaker that combines with a magnetic circuit to produce a fluctuating magnetic field which drives an acoustic diaphragm into vibration to produce a warning alarm. The metal base assembly comprises a top pad, a middle pad, a bottom plate, positioning rivets, a magnetic plate and a metal plate. The positioning rivets couple the top pad, the middle pad and the bottom plate together forming the metal base assembly with a recess cavity for accommodating the magnetic plate and the metal plate. Under influence of a magnetic force generated by a circular magnetic field generator, an acoustic diaphragm inside the speaker is made to vibrate rapidly producing a high tone warning alarm.

10 Claims, 5 Drawing Sheets

METAL BASE DESIGN FOR A SPEAKER

BACKGROUND OF THE INVENTION

1. Field of Invention

The present invention relates to a component in anti-theft installation. More particularly, the present invention relates to a metal base assembly inside a speaker capable of generating a high tone warning sound.

2. Description of Related Art

Due to the rapid economic development of our society, the material quality of our life continues to improve. Transport vehicles such as cars or motorcycles are often used to convey people to and from work or for leisure travel. In fact, they have become an almost indispensable part in the life of most families.

In general, most new cars or motorcycles are equipped with two anti-theft systems for burglary prevention. In addition to a lock guarding the engine starter, door locks and an anti-theft alarm system are frequently included for added security.

Among the many installations in an anti-theft system, the most important one is a high-tone speaker. The high tone warning sound produced by a speaker is quite effective in scaring off would-be burglars. The high tone sound of a speaker is generated by the rapid vibration of an acoustic diaphragm whose motion is in turn induced by a rapidly changing magnetic field.

The rapidly changing magnetic field is produced by supplying a current and forming a complete magnetic circuit through a metal base. FIG. 1 is an exploded view of components in a conventional anti-theft speaker together with an unit assembled from these components. A speaker 20 as shown in FIG. 1 comprises several components, including: a speaker casing 10, a mounting block 12, an acoustic diaphragm assembly 14, a plastic pad 16 and a metal base 18 for forming a magnetic circuit.

The speaker casing 10 has a plurality of guiding pins 22 protruding from the bottom surface. The guiding pins 22 are inserted into holes (not shown) on the mounting block 12 during an assembling process. The mounting block 12 also has a few holes (not shown) reserved for putting screws 30 in so that the acoustic diaphragm assembly 14, the plastic pad 16 and the metal base 18 can be attached together. The mounting block 12 also has a few slots permitting wires from the acoustic diaphragm assembly 14 and other structural elements to exit.

The acoustic diaphragm assembly 14 couples with the mounting block 12 in such a way that the side with a bulging diaphragm 26 faces the interior of the mounting block 12. When the diaphragm 26 vibrates, a high tone sound is produced. The other side of the acoustic diaphragm assembly 14, on the other hand, hides a circular magnetic field generator (not shown). When a proper electrical signal is fed into a magnetic coil inside the generator via wires 28, a rapidly fluctuating magnetic field is produced. The changing magnetic field in combination with the metal base 18 can induce vibration of the diaphragm 26.

The plastic pad 16 is a component for stationing the acoustic diaphragm assembly 14. Inside the metal base 18, there is a circular recess cavity 34 for accommodating the circular magnetic field generator on the acoustic diaphragm assembly 14. The metal base 18 has a plurality of holes 32 around the peripheral region for accommodating the screws 30 after it passes through the mounting block 12.

FIG. 2 is a diagram showing the components of the metal base illustrated in FIG. 1. The metal base 18 comprises a metal plate 35, a magnetic plate 36 and a base block 38. The metal plate 35 and the magnetic plate 36 are both circular and their diameters are the same. The metal base 18 has a circular recess cavity 37 in the middle with an internal diameter slightly larger than the diameters of the metal plate 35 and the magnetic plate 36. A circular recess cavity 34 (refer to FIG. 1) remains even after the magnetic disk 36 and the metal disk 35 are slipped into the recess cavity 37 in sequence. As mentioned before, the cavity 34 is used for housing the circular magnetic generator on the acoustic diaphragm assembly 14.

In addition, there is a stationing hole 39 in the center of the recess cavity 37 for fixing the magnetic plate 36 via the base block 38 with a guiding pin (not shown) from below. A few concentric grooves (not shown) of different sizes are also formed on the bottom surface of the base block 38. These concentric grooves are aids for dissipating the heat generated by the speaker. Without any mechanism for dissipating the heat, the magnetic plate 36 may rise to a temperature over 120° C. resulting in its demagnetization. Since the base block 38 is formed in a single piece, exposed surfaces are quite limited. Hence, its heat dissipation capacity is intrinsically poor. Furthermore, due consideration must be made regarding the design of cavity 37 so that excessive magnetic flux leakage is prevented. This leakage occurs because some material on the opposite side of the cavity must be carved away to form the concentric grooves. Hence, the base block 38 is harder and more costly to build.

SUMMARY OF THE INVENTION

Accordingly, the purpose of the present invention is to provide a multi-plate metal base assembly for a speaker. All the component plates of the assembly are easy to produce and simple to assemble so that the assembly can be fabricated by most manufacturers at a reasonable cost. Moreover, the multi-plate design of the metal base is able to increase the effective area for dissipating heat away from the interior of the speaker.

To achieve these and other advantages and in accordance with the purpose of the invention, as embodied and broadly described herein, the invention provides a metal base assembly for a speaker. The metal base assembly is part of a magnetic circuit for producing a variable magnetic field. The magnetic field in turn induces an acoustic diaphragm to vibrate, thereby producing a high tone sound. The metal base assembly includes a top pad, a middle pad, a bottom plate, a plurality of positioning rivets, a magnetic plate and a metal plate.

The top pad is a circular metallic disk with a hole in the middle. The top pad has a plurality of positioning holes. The middle pad ring is also a circular metallic disk with a hole in the middle. The middle pad has a plurality of positioning holes that match the positioning holes of the top pad. The bottom plate is a circular metallic disk having, around its periphery, a plurality of positioning holes that match the positioning holes of the middle pad ring. The rivets pass through the positioning holes the bottom plate as well as through the positioning holes of the second pad and terminate inside the positioning holes of the top pad. Hence, a metal base with a recess cavity is formed. The recess cavity is formed out of the central holes of the top pad and the middle pad.

The magnetic plate and the metal plate are sequentially placed inside the recess cavity of the metal base. The magnetic plate is used for generating a variable magnetic field while the metal plate is used for containing the magnetic plate.

The rivets are designed to pass through the positioning holes of the bottom plate and the middle pad and to be locked inside the positioning holes of the top pad. Both the middle hole of the top pad and the middle hole of the middle pad have the same diameter but are slightly larger than the diameter of the circular magnetic plate and the circular metal plate. Therefore, the circular magnetic plate and the circular metal plate can be slipped inside the holes. Furthermore, the top pad, the middle pad and the bottom plate are designed to have the same external diameter. In addition, the magnetic plate can be stationed by an external positioning pin passing through an additional positioning hole in the middle of the bottom plate.

The metal base assembly can be used together with various types of speakers installed inside a car, a motorcycle and even a house. The metal base together with a speaker casing, a mounting block, an acoustic diaphragm assembly and a plastic pad form a speaker unit. The mounting block is attached to the speaker casing. The side of the acoustic diaphragm assembly having a bulging diaphragm is attached to the mounting block. The diaphragm is used for the production of sound. The other side of the acoustic diaphragm assembly has a circular magnetic field generator capable of receiving an electrical signal. The acoustic diaphragm is attached to the plastic pad, and the plastic pad is in turn coupled to the metal base assembly of this invention.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DESCRIPTION OF THE PREFERRED EMBODIMENTS

Figure 1:
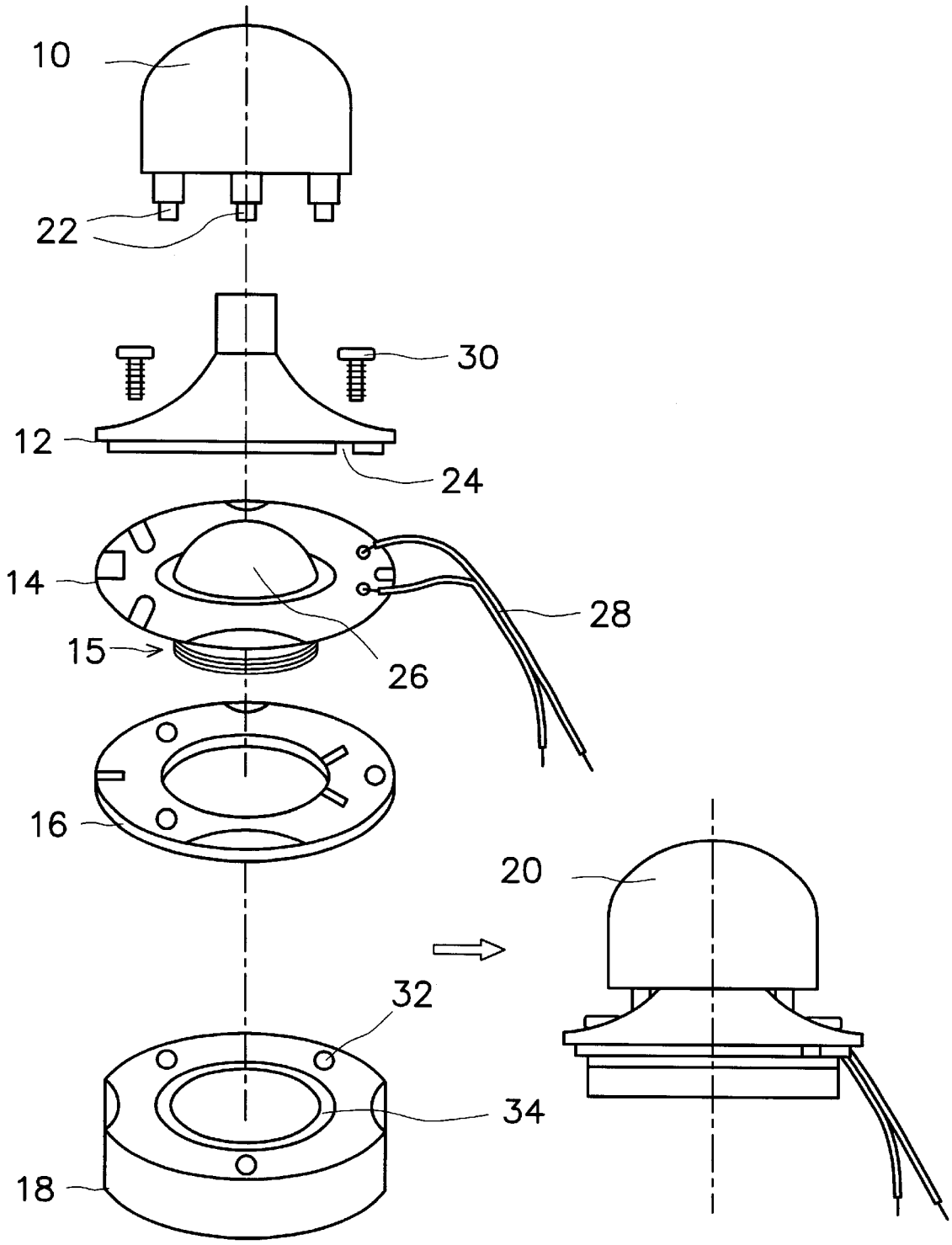
FIG. 1 (PRIOR ART)
FIG. 1 is an exploded view of components in a conventional anti-theft speaker as well as an assembled unit using those components.
Figure 2:
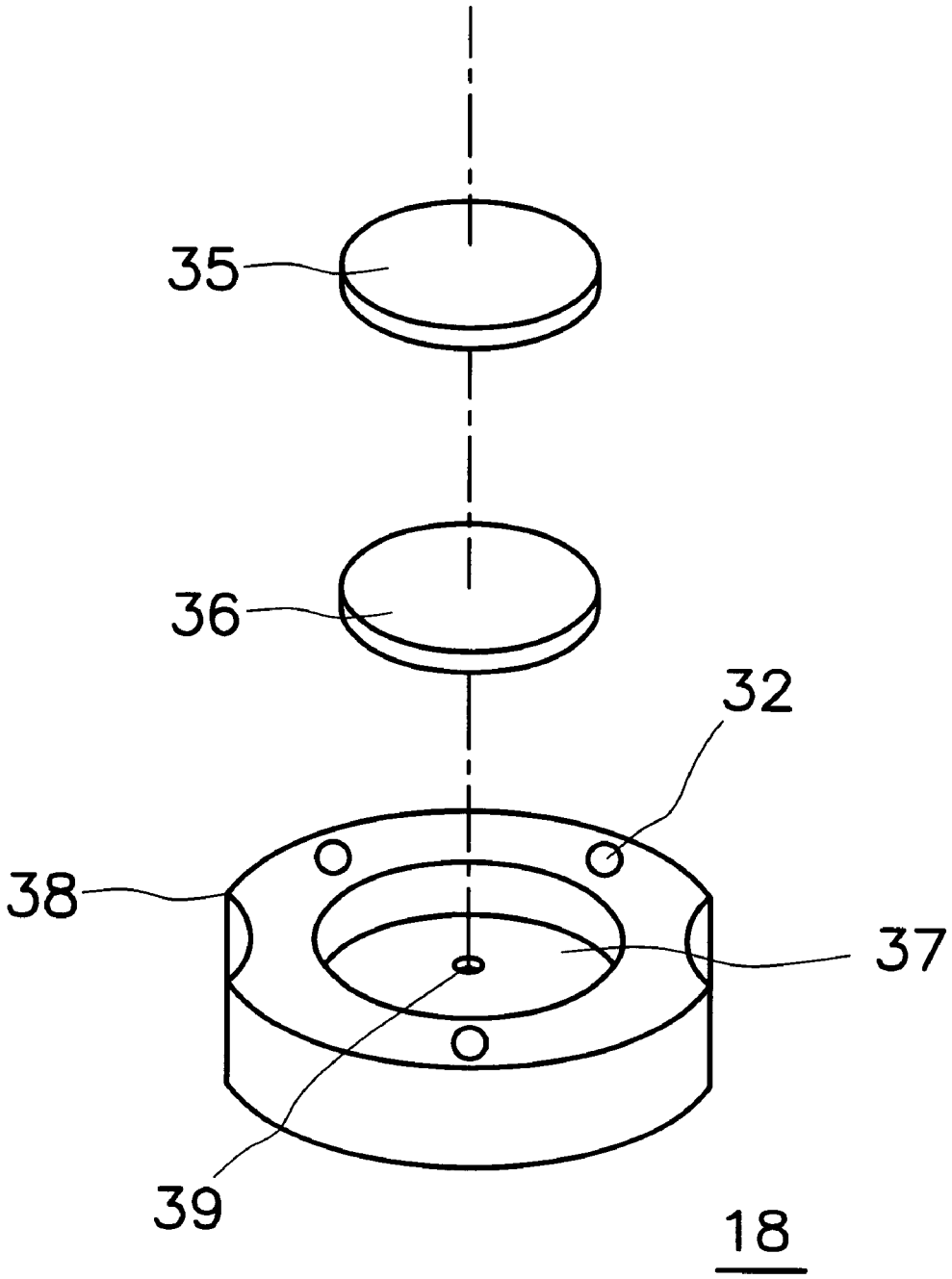
FIG. 2 (PRIOR ART)
FIG. 2 is a diagram showing the components of the metal base as shown in FIG. 1.

Reference will now be made in detail to the present preferred embodiments of the invention, examples of which are illustrated in the accompanying drawings. Wherever possible, the same reference numbers are used in the drawings and the description to refer to the same or like parts.

Figure 3:
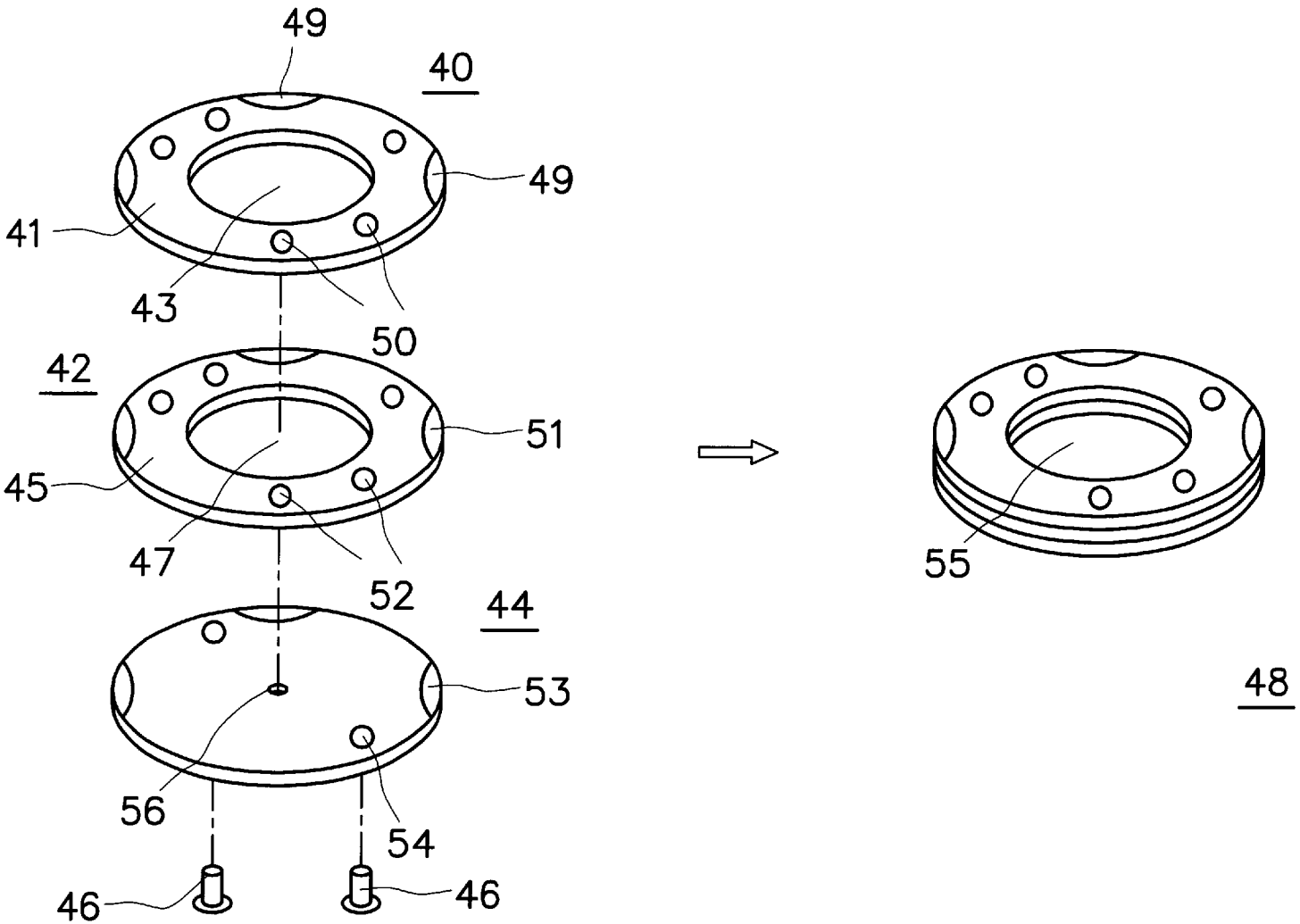
FIG. 3 is a diagram showing various components and a metal base assembly for speaker according to the invention components.
Figure 4:
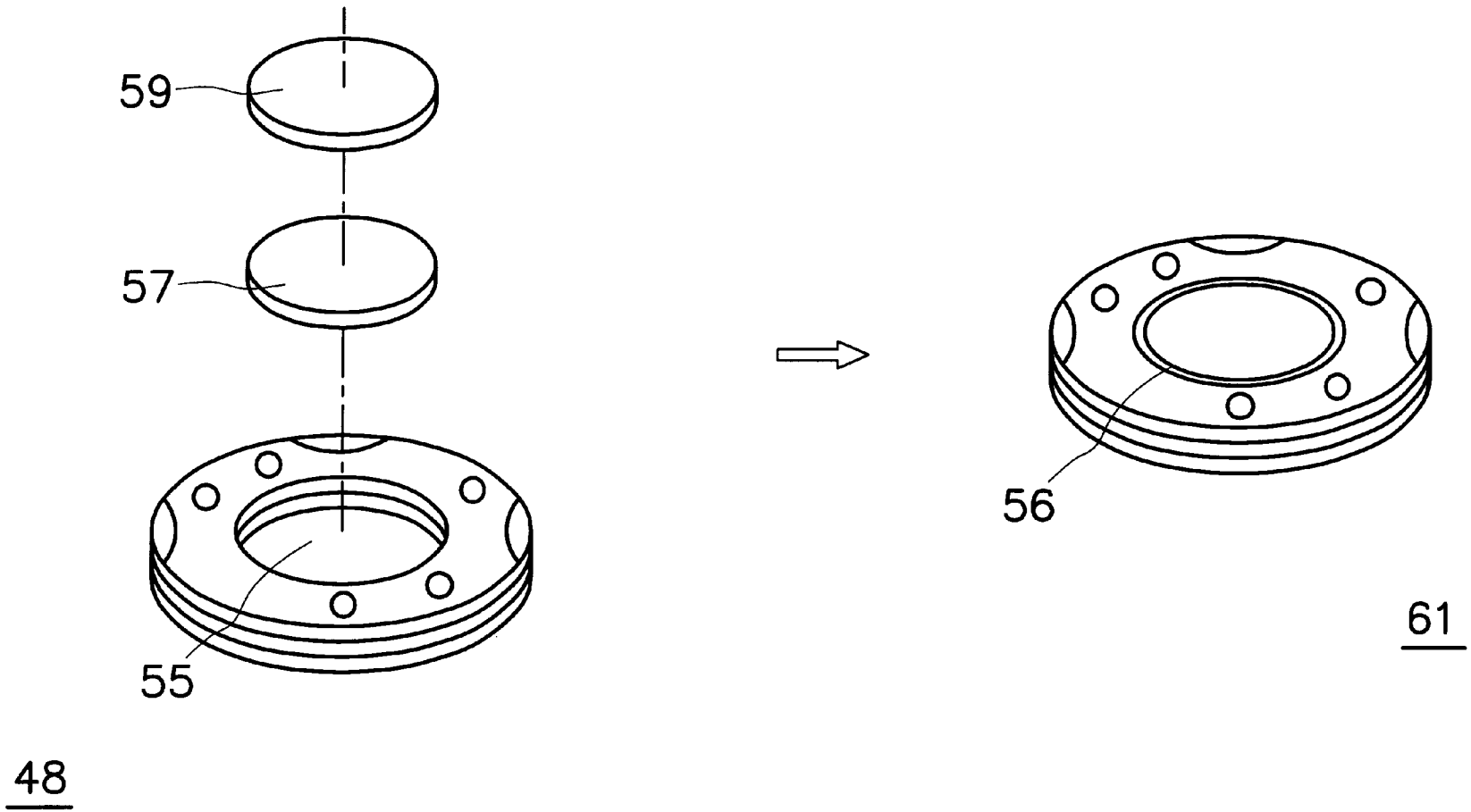
FIG. 4 is a diagram showing components including a metal base assembly of this invention, a magnetic plate, a metal plate and as an assembled unit using those components.

FIG. 3 is a diagram showing various components and a metal base assembly for a speaker according to the invention. FIG. 4 is a diagram showing components including a metal base assembly of this invention, a magnetic plate, a metal plate and a unit assembled from those components.

The metal base assembly of this invention includes a top pad 40, a middle pad 42, a bottom plate 44 and positioning rivets 46 shown in FIG. 3, and a magnetic plate 57 and a metal plate 59 shown in FIG. 4.

As shown in FIG. 3, the top pad 40 is a circular metallic disk 41 with a central hole 43. The top pad 40 has a plurality of positioning holes 50 that match a similar set of holes 52 in the middle pad 42 and a set of holes 54 in the bottom plate 44. Cuts 49 on the outer rim of the top pad 40 are designed to engage with an external structure of the speaker. The middle pad 42 is very similar in shape and size to the top pad 40. The middle pad 42 is a circular metal disk 45 with a central hole 47 and cuts 51 on the outer rim. The set of positioning holes 42 in the middle pad 42 also match the set of positioning holes 50 in the top pad 40. The central holes in the top pad 40 and the middle pad 42 form a recess cavity for accommodating the magnetic plate 57 and the metal plate 59 shown in FIG. 4.

The bottom plate 44 is a solid metallic disk coupled to the middle pad 42. The bottom plate 44 also has a set of positioning holes 54 in the peripheral region that match the positioning holes 52 of the middle pad 42. The bottom plate 44 also has a few cuts 53 on the outer rim that match the cuts 51 of the middle pad 42. To be consistent in design and use, the aforementioned top pad 40, the middle pad 42 and the bottom plate 44 all have identical shape and dimensions, for example, circular shape and equal diameters. Positioning rivets 46, each capable of passing through the positioning hole 54 of the bottom plate 44, the positioning hole 52 of the middle pad 42, and fitting tightly inside the positioning holes 50 of the top pad, are inserted. Hence, an assembled metal base 48 having a recess cavity 55 is formed. The recess cavity 55 is actually formed by the combination of the central hole 43 of the top pad 40 and the central hole 47 of the middle pad 42.

As shown in FIG. 4, the magnetic plate 57 and the metal plate 59 are sequentially placed inside the recess cavity 55 of the metal base 48. The shape and size of both the magnet plate 57 and the metal plate 59 are identical. The magnetic plate 57 and the metal plate 59, however, have an external diameter slightly smaller than the internal diameter of the recess cavity 55. After the magnetic plate 57 and the metal plate 59 are slipped into the cavity 55, a circular cavity 56 remains in the assembled metal base 61. The assembled metal base 61 is attached to some other components. The details will be explained below.

Figure 5:
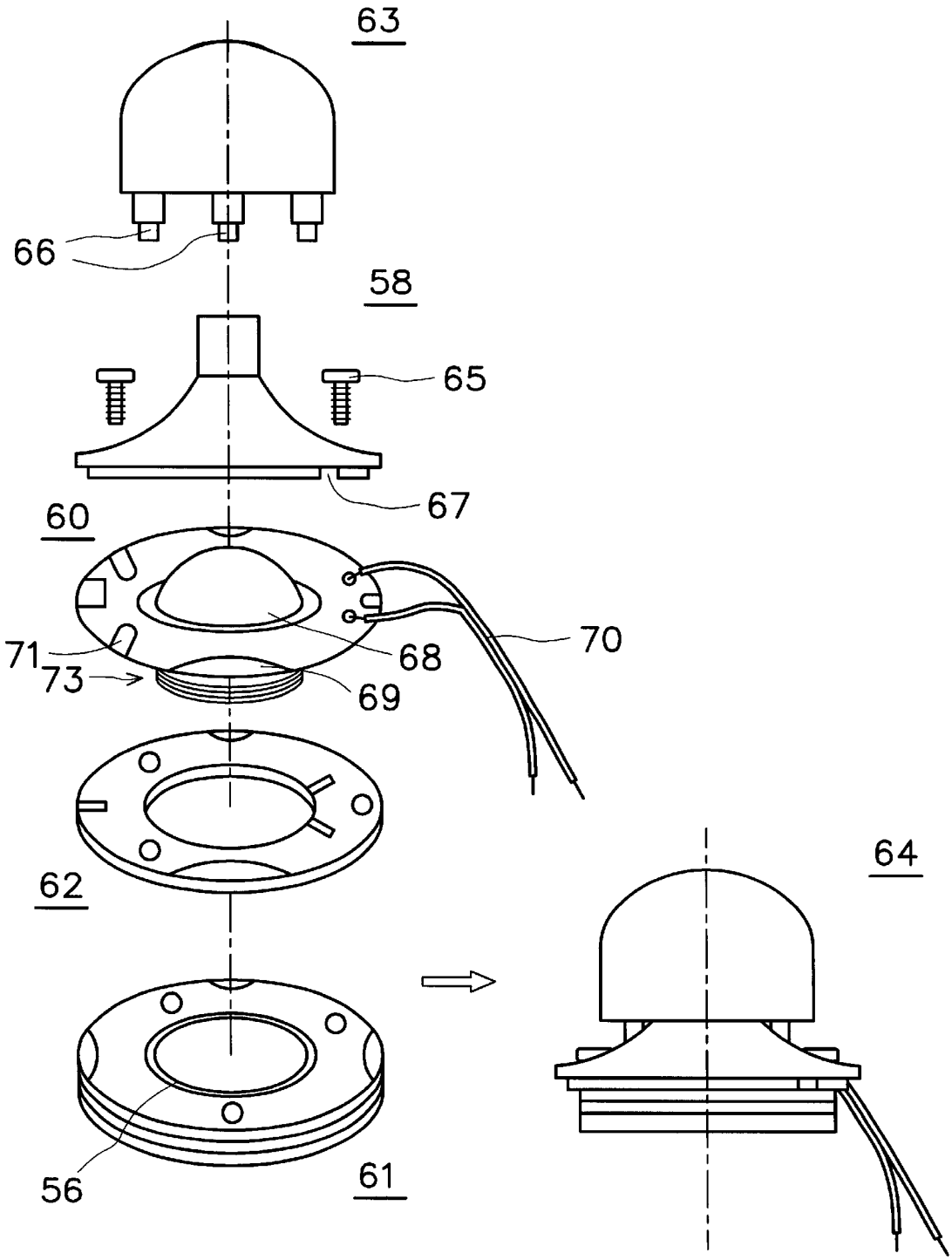
FIG. 5 is an exploded view of all the components of a speaker including the metal base assembly of this invention as well as an assembled speaker using those components.

FIG. 5 is an exploded view of all the components of a speaker including the metal base assembly of this invention as well as an assembled speaker using those components. As shown in FIG. 5, in addition to the metal base assembly 61 of this invention, a speaker 64 further includes a speaker casing 63, a mounting block 58, an acoustic diaphragm assembly 60 and a plastic pad 62.

The speaker casing 63 has a plurality of guiding pins 66 protruding from the bottom surface. The guiding pins 66 are inserted into holes (not shown) in the mounting block 58 during assembly. The mounting block 58 also has a few positioning holes (not shown) reserved for inserting screws 30 so that the acoustic diaphragm assembly 60, the plastic pad 62 and the metal base assembly 61 can be attached together. The mounting block 58 also has a few slots 67 permitting wires 70 from the acoustic diaphragm assembly 60 and other structural elements to exit.

The acoustic diaphragm assembly 60 couples with the mounting block 58 in such a way that the side with a bulging acoustic diaphragm 68 faces the interior of the mounting block 58. When the acoustic diaphragm 68 is driven into vibration, a high tone sound is produced. The other side of the acoustic diaphragm assembly 60 hides a circular magnetic field generator (not shown). When a proper electrical signal is fed into a magnetic coil inside the generator via wires 70, a rapid fluctuating magnetic field inside the speaker occurs. The changing magnetic field in combination with the metal base 61 can induce vibration of the diaphragm 68. Cuts 69 on the periphery of the acoustic diaphragm assembly 60 are used for engaging with external structures, whereas positioning slots 71 are used for positioning the diaphragm assembly 60 with screws 65. The plastic pad 62 is a component for stationing the acoustic diaphragm assembly 60. The metal base assembly 61, the plastic pad 62 and the acoustic diaphragm assembly 60 are tightened together using the screws 65. The circular recess cavity 56 in the metal base assembly 61 is used to accommodate the circular magnetic field generator on the acoustic diaphragm assembly 60. Hence, when the acoustic diaphragm is activated electrically, the diaphragm can interact with the magnetic disk 57 inside the metal base 61 to generate a fluctuating magnetic field so that the diaphragm 68 vibrates to produce sound.

In summary, the invention has a multi-plate design for the metal base of a speaker. Therefore, the metal base is easier to manufacture and costs less. In addition, the multi-plate design is able to increase effective surface area for heat dissipation.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A metal base assembly for a speaker that combines with a magnetic circuit to produce a fluctuating magnetic field which drives an acoustic diaphragm into vibration to produce a warning alarm, comprising:

a top pad, wherein the top pad is a circular metallic disk having a hole in the middle and a plurality of positioning holes around its periphery;

a middle pad connected to the top pad, wherein the middle pad is a circular metallic disk having a hole in the middle and a plurality of positioning holes around its periphery that matches the set of positioning holes in the top pad;

a bottom plate connected to the middle pad, wherein the bottom plate is a circular metallic disk having a plurality of positioning holes that matches the positioning holes in the middle pad;

a plurality of positioning rivets that pass through the positioning holes of the bottom plate and through the positioning holes of the middle pad, and terminate inside the positioning holes of the top pad, such that the top pad, the middle pad and the bottom plate together form a metal base having a recess cavity, which recess cavity results from the combination of the central holes of the top pad and the middle pad;

a magnetic plate inside the recess cavity for generating a fluctuating magnetic field; and a metal plate above the magnetic plate inside the recess cavity.

2. The metal base assembly of claim 1, wherein each positioning rivet passes through the positioning hole of the bottom plateand the positioning hole of the middle pad, and tightly locks inside the positioning hole of the top pad.

3. The metal base assembly of claim 1, wherein the hole in the top pad and the hole in the middle pad are both circular and have a same diameter, and the magnetic plate and the metal plate are both circular and have a same diameter, such that the diameter of the top/middle pad is slightly larger than the diameter of the magnetic/metal plate.

4. The metal base assembly of claim 1, wherein the top pad, the middle pad and the bottom plate all are circular and have a same outer diameter.

5. The metal base assembly of claim 1, wherein the bottom plate further includes a base plate positioning hole in the middle for stationing the magnetic plate with a guide pin.

6. A speaker assembly, comprising:

a speaker casing;

a mounting block coupled to the speaker casing;

an acoustic diaphragm assembly coupled to the mounting block, wherein one side of the acoustic assembly has an acoustic diaphragm for generating sound while the other side of the acoustic assembly has a circular magnetic field generator for receiving an input electrical signal;

a plastic pad coupled to the acoustic diaphragm assembly for stationing the acoustic assembly; and a metal base assembly coupled to the plastic pad and the acoustic diaphragm assembly, wherein the metal base assembly further includes:

a top pad, the top pad is a circular metallic disk having a hole in the middle and a plurality of positioning holes around its periphery;

a middle pad connected to the top pad, the middle pad is a circular metallic disk having a hole in the middle and a plurality of positioning holes around its periphery that matches the set of positioning holes in the top pad;

a bottom plate connected to the middle pad, the bottom plate is a circular metallic disk having a plurality of positioning holes that matches the positioning holes in the middle pad;

a plurality of positioning rivets that passes through the positioning holes of the bottom plate, the positioning holes of the middle pad and buried inside the positioning holes of the top pad, hence the top pad, the middle pad and the bottom plate together forms a metal base having a recess cavity, wherein the recess cavity results from the combination of the central holes of the top pad and the middle pad;

a magnetic plate inside the recess cavity for generating a fluctuating magnetic field; and a metal plate above the magnetic plate inside the recess cavity.

7. The speaker assembly of claim 6, wherein each positioning rivet passes through the positioning hole of the bottom plate, the positioning hole of the middle pad and tightly locked inside the positioning hole of the top pad.

8. The speaker assembly of claim 6, wherein the hole in the top pad and the hole in the middle pad are both circular with the same diameter and the magnetic plate and the metal plate are both circular with the same diameter such that the diameter of the top/middle pad is slightly larger than the diameter of the magnetic/metal plate.

9. The speaker assembly of claim 6, wherein the top pad, the middle pad and the bottom plate are all circular having the same outer diameter.

10. The speaker assembly of claim 6, wherein the bottom plate further includes a base plate positioning hole in the middle for stationing the magnetic plate with a guide pin.

* * * * *